US006446959B2

(12) United States Patent
Butterfass et al.

(10) Patent No.: US 6,446,959 B2
(45) Date of Patent: Sep. 10, 2002

(54) DEVICE FOR ALIGNING SHEETS LATERALLY

(75) Inventors: Hans Butterfass, Heidelberg; Markus Möhringer, Mannheim; Markus Röper, Schriesheim, all of (DE)

(73) Assignee: Heidelberger Druckmaschinen A.G., Heidelberg (DE)

( * ) Notice: Subject to any disclaimer, the term of this patent is extended or adjusted under 35 U.S.C. 154(b) by 0 days.

(21) Appl. No.: 09/740,636

(22) Filed: Dec. 18, 2000

(30) Foreign Application Priority Data

Dec. 16, 1999 (DE) ..... 199 61 048

(51) Int. Cl.[7] ..... B65H 9/00

(52) U.S. Cl. ..... 271/226; 271/238; 271/240; 271/250

(58) Field of Search ..... 271/226, 236, 271/238, 240, 248, 250

(56) References Cited

U.S. PATENT DOCUMENTS 4,260,149 A * 4/1981 Melzer ..... 271/195
4,264,068 A * 4/1981 Melzer ..... 271/241
4,533,134 A * 8/1985 Galster ..... 271/238
4,597,143 A * 7/1986 Dombrowski ..... 29/27 R

FOREIGN PATENT DOCUMENTS

DE 972 459 1/1956
DE 44 15 494 C2 11/1995

* cited by examiner

*Primary Examiner*—David H. Bollinger
(74) *Attorney, Agent, or Firm*—Laurence A. Greenberg; Werner H. Stemer; Ralph E. Locher

(57) ABSTRACT

A device for aligning sheets laterally on a feed table of a sheet-processing machine, having a side stop, includes a suction pull nozzle movable transversely to a sheet transport direction and being formed with a plurality of suction openings, the suction openings being distributed so that the number of suction openings arranged in the sheet transport direction becomes greater in a transverse direction towards the side stop.

12 Claims, 5 Drawing Sheets

1
2
3
4
6
7
8
9
10
11
12
13
14
16
17
18
19
21
22;23
24
25
26

DEVICE FOR ALIGNING SHEETS LATERALLY

BACKGROUND OF THE INVENTION

Field of the Invention

The invention relates to a device for aligning sheets laterally, in particular, in the feeder of a sheet-processing machine.

In order to feed a sheet with proper alignment to a sheet-processing machine, for example, a printing machine, it is necessary to align the sheet in the circumferential direction at so-called front guides or lays and to align it laterally at so-called side stops. For this purpose, the sheet is conveyed against the front guides by a suitable transporter, and is drawn against the side stops by a so-called side pulling device.

The German Patent 972 459, for example, discloses the use of a suction pull rail, which sucks the sheet from below by a suction nozzle and conveys the sheet against a side stop. To prevent the sheet from escaping upwardly when it impacts the side stop, a hold-down plate is provided in order to hold the sheet down on the feed table.

Such hold-down plates, however, have the disadvantage that a sheet which is aligned in the leading region thereof as it is conveyed into the sheet-processing machine must also be conveyed through, under the down-holder at the trailing end thereof. Extremely small skewed sheet positions or skewed sections lead to sheet warping at the side stops and the down-holder, respectively. If a sheet is drawn into the printing unit in a warped condition, however, this has a detrimental effect upon the feed register and upon ghosting caused by the feeder.

SUMMARY OF THE INVENTION

It is accordingly an object of the invention to provide a device for aligning sheets laterally which manages without a down-holder in the region of the side stops.

With the foregoing and other objects in view, there is provided, in accordance with one aspect of the invention, a device for aligning sheets laterally on a feed table of a sheet-processing machine, having a side stop, comprising a suction pull nozzle movable transversely to a sheet transport direction and being formed with a plurality of suction openings, the suction openings being distributed so that the number of suction openings arranged in the sheet transport direction becomes greater in a transverse direction towards the side stop.

In accordance with another feature of the invention, the suction openings are formed as suction bores.

In accordance with a further feature of the invention, the suction bores have greater diameters in the direction towards the side stop than towards a center of the feed table.

In accordance with an added feature of the invention, the suction openings are distributed in the form of a triangle.

In accordance with an additional feature of the invention, the suction openings are distributed in the form of a semicircle.

In accordance with yet another feature of the invention, the aligning device includes a suction chamber for supplying vacuum to the suction bores, the suction chamber being divided into two subchambers in the transverse direction, the suction chamber being constructed so as to be disconnectable.

In accordance with yet a further feature of the invention, the aligning device includes a slide operatable in an infinitely variable manner in the transverse direction for closing the suction bores.

In accordance with another aspect of the invention, there is provided a device for aligning sheets laterally on a feed table of a sheet-processing machine, having a suction pull nozzle movable transversely to a sheet transport direction and having a plurality of suction openings, comprising a side stop formed with a slope extending in a direction of a sheet lateral edge.

In accordance with an added feature of the invention, an imaginary extension of the slope forms an acute angle with a transport plane of the feed table.

In accordance with a third aspect of the invention, there is provided a device for aligning sheets laterally on a feed table of a sheet-processing machine, having a side stop and a suction pull nozzle movable transversely to a sheet transport direction, and being formed with a plurality of suction openings, comprising a run-on slope formed on the side stop, the run-on slope being oriented counter to the sheet transport direction.

In accordance with another feature of the invention, the run-on slope forms an acute angle with a sheet guide plane.

In accordance with a concomitant feature of the invention, the run-on slope is constructed so as to extend below a sheet guide plane.

A particular advantage of the invention is that a suction force acting on the sheet through the suction nozzle is distributed over suction openings in such a way that the number of suction openings in the sheet transport direction is higher than in the transverse direction, or is at least equally high. The sheet to be transported is thereby held securely by the suction nozzle, with a small total holding force, in particular in the edge region of the sheet. Due to this measure, the sheet is able to execute a relative movement with respect to the suction nozzle the instant the side edge of the sheet contacts the side stop, so that the edge is not damaged. The distribution of the suction force in accordance with the invention, a greater suction force being provided in the edge region of the sheet, causes the edge of the sheet not to wander upwardly, even when it strikes the side stop. Therefore, down-holders in the region of the side stops can be dispensed with.

Dispensing with down-holders makes it possible for the sheet that is transported away to slide over the side stops in order to relieve stress. Run-on slopes advantageously arranged on the side stops assist this measure.

Moreover, a further run-on slope directed counter to the sheet transport direction is provided on the side stop, and makes it possible for a laterally, negatively offset oncoming sheet not to be caught or remain hanging on the side stop but to slide over the latter. In order to rule out the possibility of the side stop being a stumbling block, the run-on slope is formed to-extend below the sheet guide plane.

Other features which are considered as characteristic for the invention are set forth in the appended claims.

Although the invention is illustrated and described herein as embodied in a device for aligning sheets laterally, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

Figure 1:
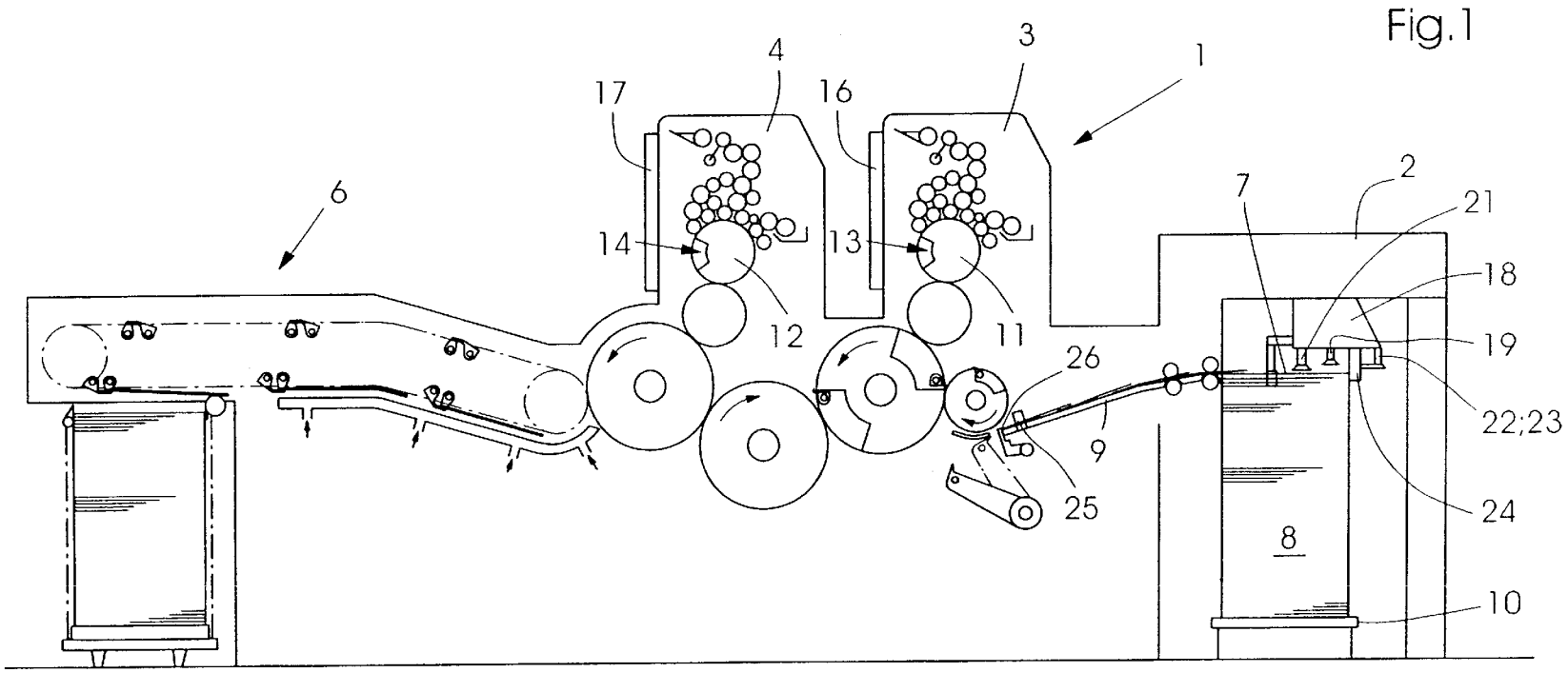
FIG. 1 is a diagrammatic side elevational view of a sheet-fed rotary printing machine incorporating a device for aligning sheets laterally in accordance with the invention.
Figure 2:
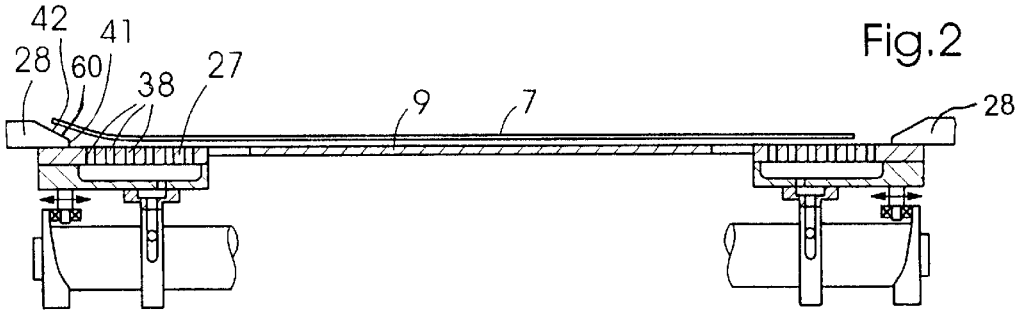
FIG. 2 is an enlarged cross-sectional view of FIG. 1, showing the device for aligning sheets laterally in greater detail.

Description of the Preferred Embodiments:

Referring now to the drawings and, first, particularly to FIG. 1 thereof, there is shown therein, a rotary printing machine, for example, a printing machine 1 for processing sheets 7, having a feeder 2, at least one printing unit 3 and/or 4 and a delivery 6. The sheets 7 are taken from a sheet pile 8 and, in separated or overlapped relationship, are fed over a feed table 9 to the printing units 3 and 4, which include, in a conventional manner, plate cylinders 11 and 12, respectively, each of which has a device 13, 14 for fastening flexible printing plates thereon. Furthermore, each plate cylinder 11, 12 has assigned thereto a respective device 16, 17 for changing printing plates semi-automatically or fully automatically.

The sheet pile 8 lies on a controllingly liftable stacking plate 10. The sheets 7 are taken from the top of the sheet pile 8 by a so-called suction head 18, which, among other parts, has a number of lifting and dragging suckers 19 and 21 for separating or singling the sheets 7. In addition, blowing or bias. devices 22 are provided for loosening the upper sheet layers, as are sensing elements 23 for tracking the sheet pile 8. In order to align the sheet pile 8, in particular, the upper sheets 7 of the sheet pile 8, a number of lateral and rear stops are provided.

The sheet 7 is fed over the feed table 9 to front alignment devices in the form of so-called front guides or lays 26 and aligned in circumferential direction at the front guides 26. A side pulling device 25 has, among other parts, a suction pull nozzle 27 which is movable transversely to the sheet transport direction.

Figure 3:
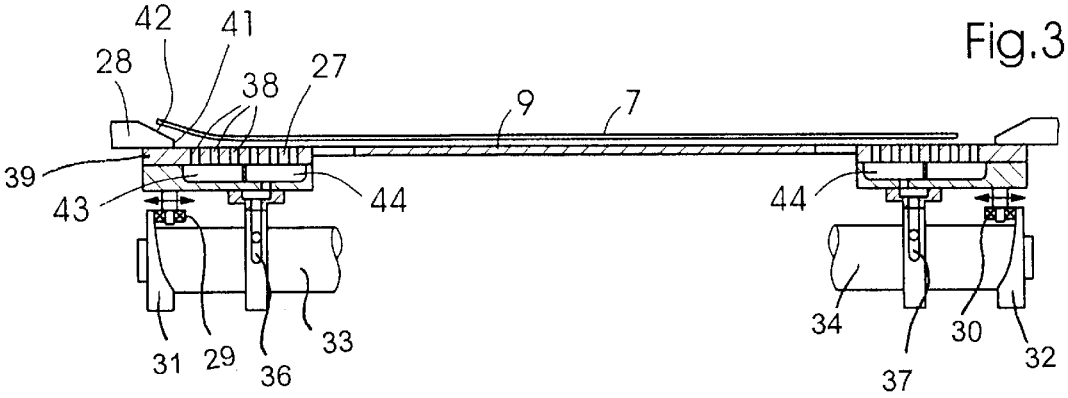
FIG. 3 is a view like that of FIG. 2 showing another embodiment of the device for aligning sheets laterally in accordance with the invention, which has a suction chamber that is divided, in contrast with the construction of FIG. 2.

After the circumferential alignment is performed, the sheet 7 is subjected at a leading region thereof to suction by the suction pull nozzle 27 disposed in the feed table 9, and is moved in a pull channel 60 towards a lefthand or right-hand side stop 28. The movement of the suction pull nozzle 27 in the exemplary embodiment according to FIG. 3 is performed by a respective control roller 29, 30, which is in contact, during operation, with a control contour of a respective axially aligned control cam 31, 32. The control cams 31, 32, respectively, are seated on a control shaft 33, 34 which is driven at the cycle speed rate of the sheet-processing machine. The control shafts 33 and 34 can also be formed as one common shaft.

The suction pull nozzle 27 is supplied with vacuum via a suction connection, for example, via a respective control groove 36, 37 formed in the respective cyclically driven control shaft 33, 34.

The suction nozzle 27 has a number of suction bores 38, which are arranged distributed in a movable pull plate 39 so that a suction area Fs that acts upon the sheet 7 becomes larger in the direction of the respective side or lateral stop 28.

Figure 5:
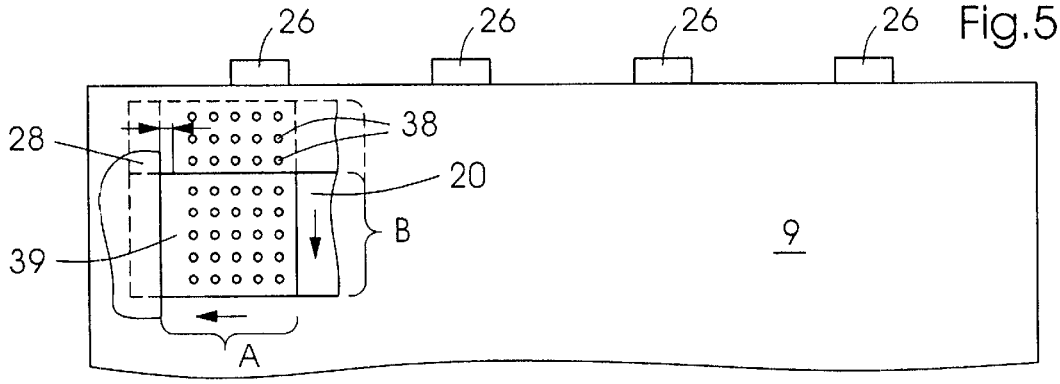
FIG. 5 is a top plan view of a side stop having a suction pull nozzle according to the invention.

According to the invention, for example, as shown in FIG. 5, the number of bores 38 of equally large size which are arranged on the pull plate 39 in the sheet transport direction B is equal to or greater than the number of bores 38 of equally large size which are arranged on the pull plate 39 in the transverse direction A. From this, the ratio of the number of equally large bores 38 in the pull plate 39 is $B/A \geqq 1$.

Figure 6:
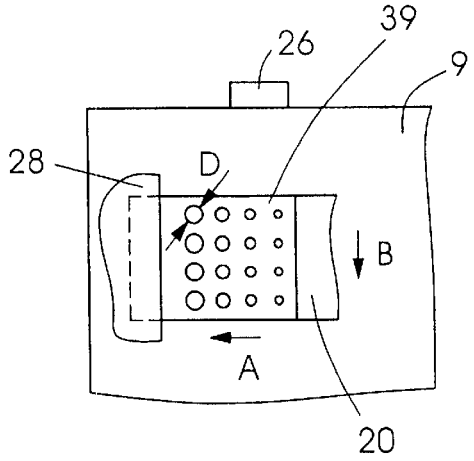
FIGS. 6 to 8 are views like that of FIG. 5 showing further embodiments of the suction pull nozzle.

In a second embodiment, according to FIG. 6, the suction area Fs is increased towards the edge region of the sheet 7, for example, by making the bore diameters D in the pull plate 39 greater towards the side or lateral stop 28 than towards the center of the feed table 9.

Figure 7:
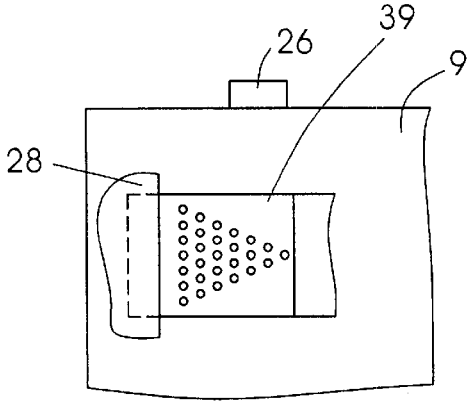

In a third embodiment, according to FIG. 7, the number of equally large bores 38 in the pull plate 39 are greater towards the side or lateral stop 28 than towards the center of the feed table 9. This can be achieved, for example, by a triangular pull plate 39 or a triangular distribution of the bores 38 in the pull plate 39.

Figure 8:
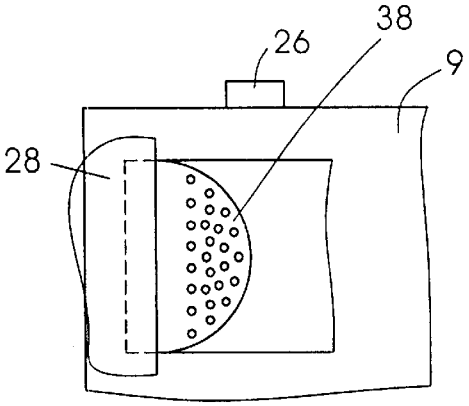
Figure 9:
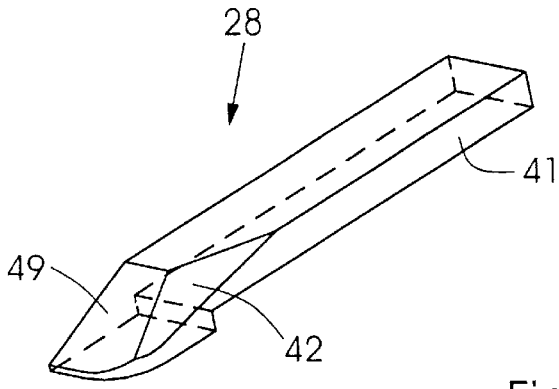
FIG. 9 is a front, top and side perspective view of a side or lateral stop according to the invention.

In a fourth embodiment, according to FIG. 8, there is a distribution of bores 38 of equal size in the pull plate 39 corresponding to a semicircular area, so that the number of the equally large bores 38 is greater towards the side or lateral stop 28 than towards the center of the feed table 9.

In a further embodiment, as shown in FIG. 3, the suction pull nozzle 27 is provided with two suction chambers 43 and 44 arranged transversely with respect to the sheet transport direction B, i.e., in the lateral pulling direction A (in this regard, note FIGS. 5 and 6). Depending upon the thickness of the printing material, in particular when processing thick sheets, both suction chambers 43 and 44 can be activated. When processing thin printing materials, respectively, only the suction chamber 43 arranged closer to the side or lateral stop 28 is activated, as a result of which, the distribution of the holding force in the side region of the sheet is greatest, with respect to the total holding force.

Figure 4:
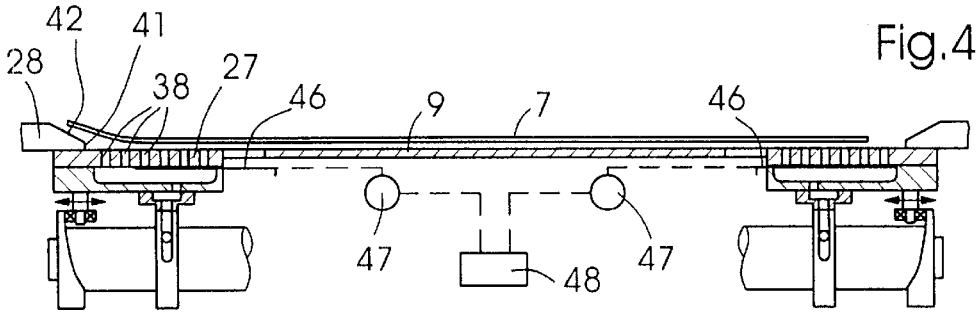
FIG. 4 is a view like those of FIGS. 2 and 3 showing a third embodiment of the device for aligning sheets laterally, which has a slide.

In a further embodiment, as shown in FIG. 4, for example, a proposal is made to use a slide 46 arranged between the suction openings and the respective suction chambers 43 and 44, the slide 46 being displaceable continuously in the direction of the side stop 28 depending upon the thickness of the printing material to be processed, so that during the processing of thin printing materials, only the suction openings 38 which act upon the sheet 7 in the side region are effective and, during the processing of thick printing materials, correspondingly more suction openings 38 are effective. The slide 46 is arranged to be adjustable via a setting motor 47 and is set automatically by the control system 48 of the printing machine depending upon the thickness of the printing material to be processed.

A surface of the pull plate 39 lies in a plane with the feed table 9 and, during the side pulling operation, slides underneath the side stop 28. The side stop 28 has a stop face 41 disposed vertically with respect to the sheet guide plane 50. This face 41 extends upwardly from the sheet guide plane 50 and ends there in a slope 42, an imaginary extension of which forms an acute angle with the sheet guide plane 50.

The slope 42 assists in the relief of stress in the sheet as the latter is conveyed away, it being possible for the sheet to slide over the side stops 28 during the process.

Figure 11:
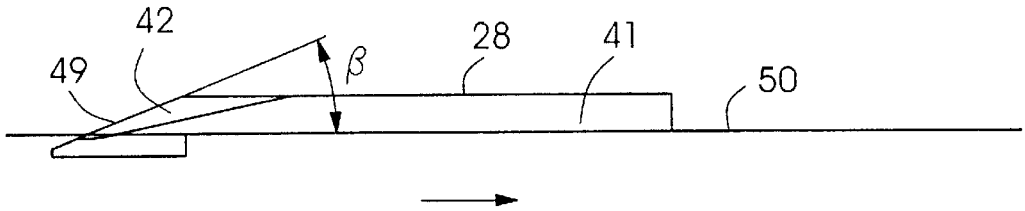
FIG. 11 is a side elevational view of FIG. 9 showing the side or lateral stop in greater detail.
Figure 10:
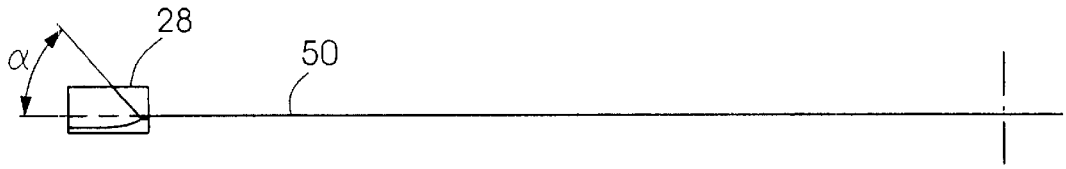
FIG. 10 is an end elevational view of FIG. 9 showing the side or lateral stop, as viewed in the sheet transport direction.
Figure 12:
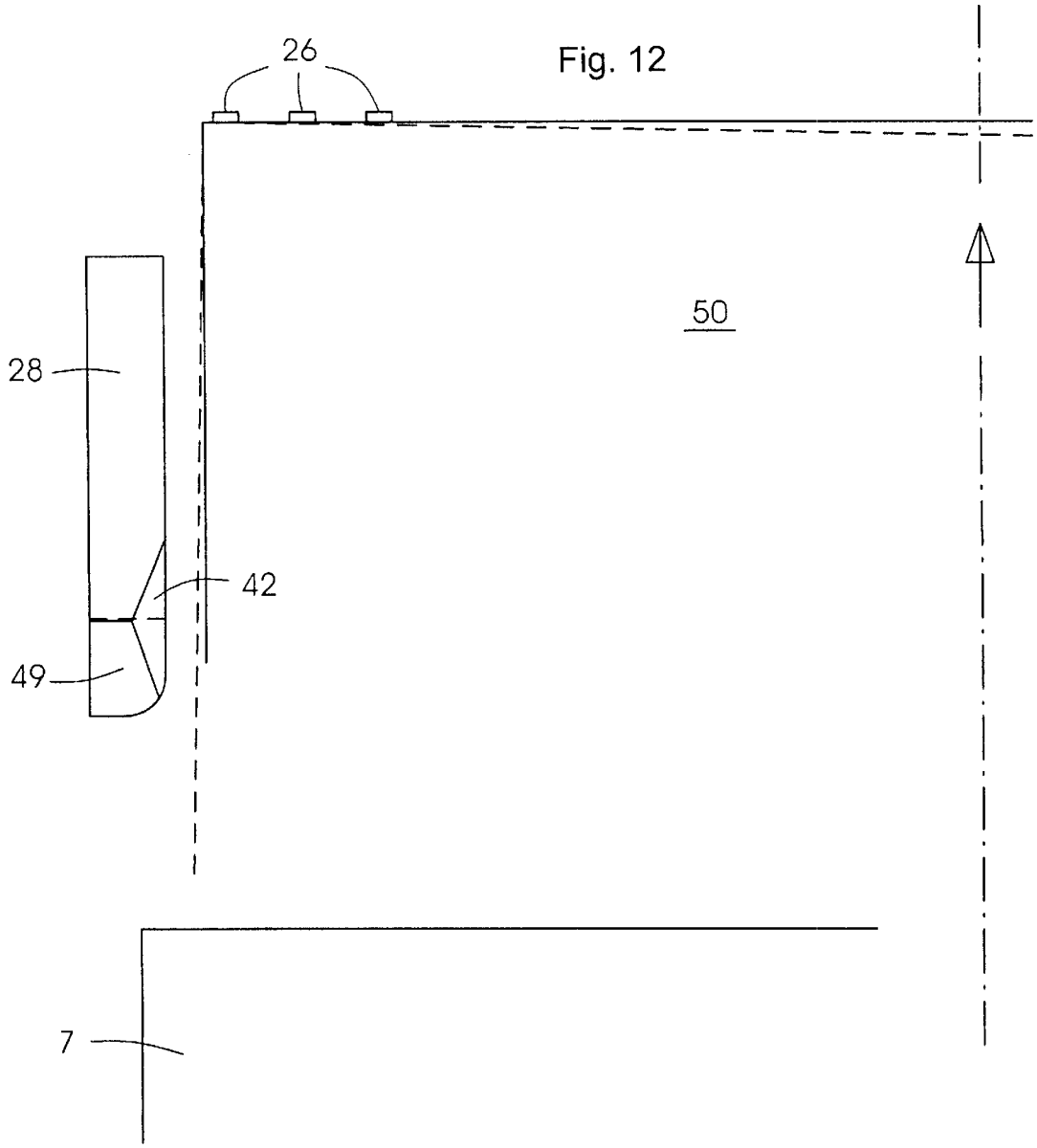
FIG. 12 is a plan view of the sheet guide plane and the side stop disposed at the lefthand side of the figure.

A further, so-called run-on slope 49 on the side stop 28 is arranged counter to the sheet transport direction. The run-on slope 49 extends beneath the sheet guide plane 50, as shown in FIG. 11, in order that no stumbling block be presented to the sheets conveyed up to the front guides. The run-on slope 49 encloses an acute angle β with the sheet guide plane 50.

The task of the run-on slope 49 is to permit sheets which arrive with a lateral offset to slide over the side stop 28. This measure prevents the oncoming sheet from being caught on the side stop 28 and, as a result, being skewed on the sheet guide plane 50 which, in the least favorable case, can lead to an interruption in the sheet feed.

Provision is made for sheets conveyed to the front guides with a negative lateral offset to be detected by a non-illustrated feed monitoring device, and for a signal to be given to the delivery 6 which, for example, ensures that a tab be fired into the delivery pile at an appropriate point, so that the sheet which has been slid over the side stop 28 without being aligned can be removed.

We claim:

1. A device for aligning sheets laterally on a feed table of a sheet-processing machine, having a side stop, comprising a suction pull nozzle movable transversely to a sheet transport direction and being formed with a plurality of suction openings, said suction openings being distributed so that the number of suction openings arranged in said sheet transport direction becomes greater in a transverse direction towards the side stop.

2. The aligning device according to claim 1, wherein said suction openings are formed as suction bores.

3. The aligning device according to claim 2, wherein said suction bores have greater diameters in said direction towards the side stop than towards a center of the feed table.

4. The aligning device according to claim 2, wherein said suction openings are distributed in the form of a triangle.

5. The aligning device according to claim 2, wherein said suction openings are distributed in the form of a semicircle.

6. The aligning device according to claim 1, including a suction chamber for supplying vacuum to said suction bores, said suction chamber being divided into two subchambers in said transverse direction, said suction chamber being constructed so as to be disconnectable.

7. The aligning device according to claim 1, including a slide operatable in an infinitely variable manner in said transverse direction for closing said suction bores.

8. A device for aligning sheets laterally on a feed table of a sheet-processing machine, having a side stop and a suction pull nozzle movable transversely to a sheet transport direction, and being formed with a plurality of suction openings, comprising a run-on slope formed on the side stop, said run-on slope being oriented counter to the sheet transport direction.

9. The aligning device according to claim 8, wherein the side stop is formed with a slope extending in a direction of a sheet lateral edge.

10. The aligning device according to claim 9, wherein an imaginary extension of said slope forms an acute angle with a transport plane of said feed table.

11. The aligning device according to claim 8, wherein said run-on slope forms an acute angle with a sheet guide plane.

12. The aligning device according to claim 8, wherein said run-on slope is constructed so as to extend below a sheet guide plane.

* * * * *